US007562782B2

(12) United States Patent
Yorita

(10) Patent No.: US 7,562,782 B2
(45) Date of Patent: Jul. 21, 2009

(54) CAP STRUCTURE FOR BEVERAGE CONTAINER

(75) Inventor: Katsuhiko Yorita, Aichi (JP)

(73) Assignees: Nippon Kouatsu Electric Co., Ltd., Aichi (JP); Jatecx Co., Ltd., Aichi (JP)

( * ) Notice: Subject to any disclaimer, the term of this patent is extended or adjusted under 35 U.S.C. 154(b) by 0 days.

(21) Appl. No.: 11/664,737

(22) PCT Filed: Sep. 28, 2005

(86) PCT No.: PCT/JP2005/017891

§ 371 (c)(1),
(2), (4) Date: Sep. 6, 2007

(87) PCT Pub. No.: WO2006/040932

PCT Pub. Date: Apr. 20, 2006

(65) Prior Publication Data

US 2008/0142471 A1 Jun. 19, 2008

(30) Foreign Application Priority Data

Oct. 8, 2004 (JP) ..... 2004-295877

(51) Int. Cl.
*B65D 51/28* (2006.01)
*B65D 81/32* (2006.01)

(52) U.S. Cl. ..... 215/228; 215/227; 215/DIG. 8; 220/521; 206/222

(58) Field of Classification Search ..... 215/227, 215/228, 386, DIG. 8; 206/221, 222; 426/115; 220/521; 222/83
See application file for complete search history.

(56) References Cited

U.S. PATENT DOCUMENTS

| | | | | | |
|---|---|---|---|---|---|
| 3,156,369 | A * | 11/1964 | Bowes et al. | 206/222 |
| 3,347,410 | A * | 10/1967 | Schwartzman | 222/80 |
| 4,793,475 | A * | 12/1988 | Itzel | 206/221 |
| 5,782,345 | A * | 7/1998 | Guasch et al. | 206/222 |
| 6,003,728 | A * | 12/1999 | Elliott | 222/81 |
| 6,152,296 | A * | 11/2000 | Shih | 206/222 |
| 6,372,270 | B1 * | 4/2002 | Denny | 426/77 |
| 6,527,109 | B2 * | 3/2003 | Schoo et al. | 206/219 |
| 6,959,839 | B2 * | 11/2005 | Roth et al. | 222/83 |
| 2005/0161348 | A1 * | 7/2005 | Morini | 206/219 |
| 2005/0211579 | A1 * | 9/2005 | Makita | 206/219 |
| 2005/0263414 | A1 * | 12/2005 | Harilela et al. | 206/221 |
| 2008/0124432 | A1 * | 5/2008 | Ma | 426/115 |

FOREIGN PATENT DOCUMENTS

JP 5-086831 U 11/1993

(Continued)

*Primary Examiner*—Sue A Weaver
(74) *Attorney, Agent, or Firm*—Morgan, Lewis & Bockius LLP

(57) ABSTRACT

A beverage container enabling a flavored tea to be tasted is provided when a powdered tea stored normally in a sealed container of a cap and a drinking water in a body are blended. The cap is provided on the body. When the cap is rotated, a force is imparted on a pressing rod extending from the bottom surface of the container. This force causes a mechanically weak portion in the bottom of the container to break, thus allowing a mixture to fall from the container into the drinking water.

7 Claims, 6 Drawing Sheets

FOREIGN PATENT DOCUMENTS

| | | | |
|---|---|---|---|
| JP | 2003-72822 | | 3/2003 |
| JP | 2004106888 | A * | 4/2004 |
| JP | 2004-276942 | | 10/2004 |
| JP | 2005-187022 | | 7/2005 |
| WO | 03/093128 | | 11/2003 |

* cited by examiner

CAP STRUCTURE FOR BEVERAGE CONTAINER

BACKGROUND OF THE INVENTION

1. Field of the Invention

The present invention relates to an improved beverage container in which a fine-powdery mixture and a drinking water are stored separately, and they are subjected to mixing for drinking the beverage.

2. Related Art

Conventionally, a beverage such as tea, coffee and juice is sold at a store or via an automatic vending machine, which is plugged into a beverage container such as a can, a bottle and a plastic bottle of PET. It takes a long time to pass these beverages to consumers and there is a problem that deliciousness becomes bad by aged deterioration during storing. Therefore, a beverage container is proposed, which is an easy-to-drink container capable of tasting the flavor of freshly brewed tea by blending a seasoning material such as powdered tea, and a drinking water just before drinking (for example, in Patent Document 1).

The invention described in JP-A 2003-72822 by the present applicant, for example, shows a structure comprising a container having a mixture in a bottle mouth of the beverage container body, a cap that is formed on an upper side of the container so as to cover the bottle mouth of the beverage container body, that has a cylindrical shape opened downward and that has a projection at the center. On an inner circumferential surface of the cylindrical part of the cap, a threaded part is provided so as to couple to a threaded part disposed outside the bottle mouth, and when both threaded parts are coupled each other, a collar having a mechanically weak portion disposed under the cap is broken.

In the above invention, the threaded part is coupled to the threaded part disposed outside the bottle mouth of the beverage container body by turning the cap while pushing down. When the cap is tightened so as to contact an upper surface of the cap with a top of the bottle mouth, a projection arranged at an upper surface of the cap breaks upper and lower surfaces of the container through and a mixture such as powdery tea is dropped down from the opening to a drinking water. After that, if the resultant mixture is stirred, it is capable of tasting the flavor of freshly brewed tea and is characterized in this.

Patent Document 1: JP-A 2003-72822

DISCLOSURE OF THE INVENTION

Problems to be Solved by the Invention

However, since the container is broken by the projection of the cap in dropping the mixture into the drinking water to mix in the above invention, a space for dropping the mixture stored in the container is small and there is a possibility of dropping no mixture. Accordingly, if the body is shaken up-and-down to stir when the mixture is insoluble such as powdery tea, an extract of the tea and the like may not permeate in the drinking water and the resultant may be a weak tea.

Further, since the container containing a mixture and the cap are individually incorporated to the container body, we could not drink in a condition where only a cap is removed from the body. And we cannot drink until the cap and the container are to be removed from the body, being troublesome. Moreover, the beverage can be stored in the course of drinking by removing the container only and attaching a cap onto the container body, however, it sometimes leads to a complex problem in disposing the removed container.

Means to Solve the Problem

The present invention is to provide a structure for drinking a fresh tea with a simple operation in order to solve the above-mentioned problem. The first invention for attaining the above-mentioned objective is a cap structure comprising a cap (1) removably to be screwed onto a bottle mouth (10*a*) of a beverage container body (10) containing a drinking water (11) therein and a container (3) disposed in the cap (1) for storing a mixture (5), characterized in that, the cap (1) has a shape in which a small diameter cylindrical part (1*a*) is bonded to the upper side of a large diameter cylindrical part (1*b*), the container (3) that has a bottom and is cylindrical is disposed so as to project downward in order to store the mixture (5) in the large diameter cylindrical part (1*b*), a mechanically weak portion (3*e*) is formed at a bottom surface (3*d*) of the container (3), a pressing rod (3*a*) that is projected upward is disposed near the mechanically weak portion (3*e*), the container (3) is supported with a pawl portion (1*h*) that is formed while extending from a circumferential side near an upper end of the large diameter cylindrical part (1*b*) of the cap (1) toward the center of the cap (1), and a locking portion (3*h*) that is formed while extending from a circumferential edge portion toward outside of an upper surface of the container (3), a pressing cap (4) disposed at an upper surface of the pressing rod (3*a*) is housed in the small diameter cylindrical part (1*a*) and is freely threaded to a threaded part (2*a*) configured in an openable lid (2) disposed while capping the small diameter cylindrical part (1*a*) of the cap (1), the cap (1) has a projection (1*d*) for guiding in the small diameter cylindrical part (1*b*), the projection (1*d*) for guiding fitted into a groove part (4*a*) formed on an outer circumferential side of the pressing cap (4) to control the rotation of the pressing cap (4), and when the openable lid (2) is rotationally moved, the pressing cap (4) is pushed downward, the pressing rod (3*a*) of the container (3) is pressed down to break the mechanically weak portion (3*e*) of the bottom surface (3*d*) and open, and the mixture (5) in the container (3) is dropped into the drinking water (11).

The second invention is a cap structure according to the first invention, wherein a lowest end part (1*g*) of the small diameter cylindrical part (1*a*) of the cap (1) and a sided circumferential surface (4*e*) of the pressing cap (4) closely contact when the mechanically weak portion (3*e*) of the container (3) is broken.

The third invention is a cap structure comprising a cap (7) removably to be screwed onto a bottle mouth (10*a*) of a beverage container body (10) containing a drinking water (11) therein and a container (3) disposed in the cap (7) for storing a mixture (5), characterized in that, the cap (7) has a shape in which a small diameter cylindrical part (7*a*) having a threaded part (7*d*) on an outer circumferential side is bonded to the upper side of a large diameter cylindrical part (7*b*), the container (3) that has a bottom and is cylindrical is disposed so as to project downward in order to store the mixture (5) in the large diameter cylindrical part (7*b*), a mechanically weak portion (3*e*) is formed at a bottom surface (3*d*) of the container (3), a pressing rod (3*a*) that is projected upward is disposed near the mechanically weak portion (3*e*), the container (3) is supported with a pawl portion (7*f*) that is formed while extending from a circumferential side near an upper end of the large diameter cylindrical part (7*b*) of the cap (7) toward the center of the cap (7), and a locking portion (3*h*) that is formed while extending from a circumferential edge portion toward outside of an upper surface of the container (3), an openable lid (6) that is disposed at an upper surface of the pressing rod (3*a*) of the container (3), has a cylindrical shape downward and comprises a projected portion (6*a*) on a center of the upper side, caps the small diameter cylindrical part (1*a*) of the cap (7) and is freely threaded to a threaded part (7*d*), and when the openable lid (6) is rotationally moved, the pressing rod (3*a*) of the container (3) is pressed down with the projected portion (6*a*) to break the mechanically weak portion (3*e*) of the bottom surface (3*d*) and open, and the mixture (5) in the container (3) is dropped into the drinking water (11).

The fourth invention is a cap structure according to the third invention, wherein a tip part (7*e*) of the small diameter cylindrical part (7*a*) of the cap (7) and a sealing member (6*d*) on an upper face of the openable lid (6) closely contact when the mechanically weak portion (3*e*) of the container (3) is broken.

The fifth invention is a cap structure according to either the first or third invention, wherein a knob part (3*f*) is disposed at a bottom surface (3*d*) of the container (3).

Effect of the Invention

According to the present invention, a flavor just ground can be conserved for a long time since the mixture (5) in the container (3) is completely sealed with a sealing member (3*b*) which is put on an upper surface of the container (3).

The openable lid (2) is only turned to blend the mixture (5) and the drinking water (11) with a simple operation. Therefore, leakage of the liquid may be suppressed since the lowest end part (1*g*) of the cap (1) and the contacting portion (4*e*) of the pressing cap (4) are closely contacted according to Claim 2, and the highest end part (7*e*) of the cap (7) and the sealing member (6*d*) of the openable lid (6) are closely contacted according to Claim 4 after blending. Further, since the opened part (3*c*) of the container (3) is widely opened, all of the mixture (5) is dropped down to the drinking water (11) and a flavored good tea just made can be tasted anytime.

When the bottom surface (3*d*) of the container (3) is broken, the bottom surface (3*d*) never drops down to the drinking water (11). Therefore, a floating of fractions of the bottom surface (3*d*) in the drinking water (11) and the like is suppressed, being preferable in sanitary and safety.

In addition, since the container (3) can be easily removed from the cap (1), exchanging the container with another container (3) having the other mixture leads to enjoying various tastes.

DESCRIPTION OF REFERENCE NUMERALS AND SIGNS

Figure 1:
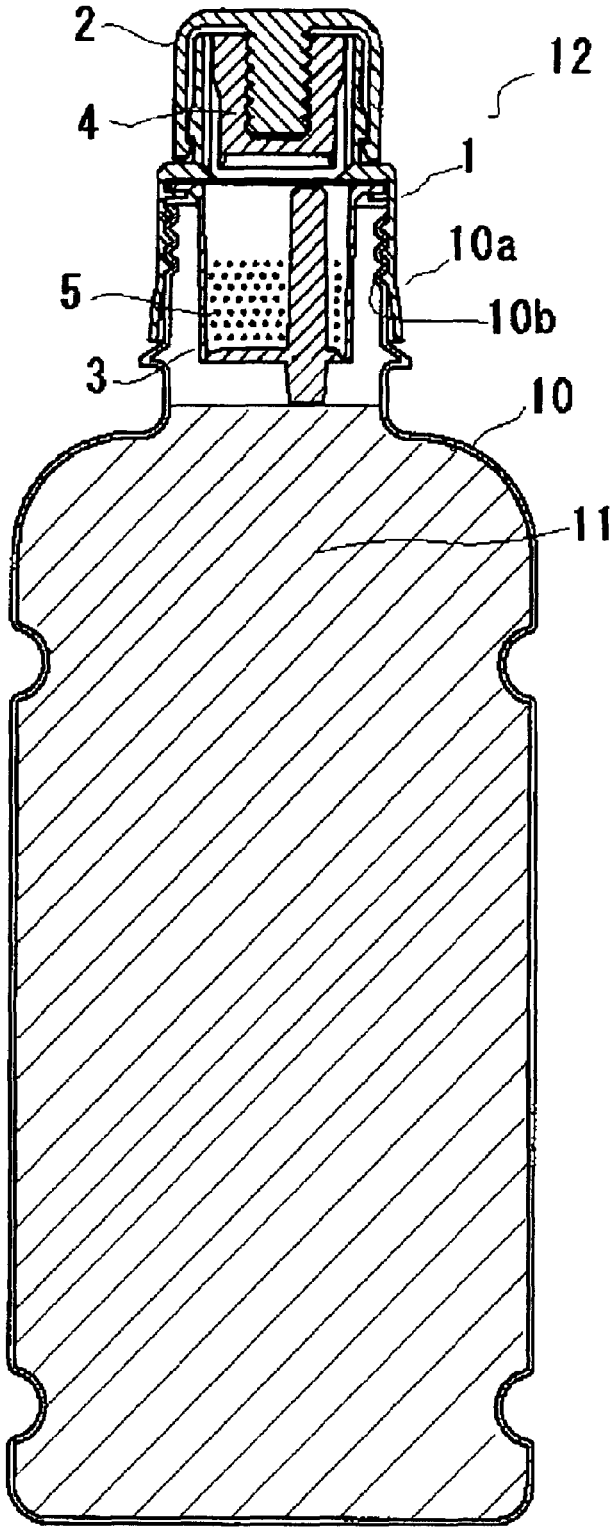
FIG. 1 It is an explanatory view of Example 1 according to the present invention.

1 cap
1*a* small diameter cylindrical part
1*b* large diameter cylindrical part
1*c* threaded part
1*d* projection for guiding
1*e* projection for locking
1*f* wall
1*g* lowest end part
1*h* pawl portion
2 openable lid
2*a* threaded part
2*b* locking portion
3 container
3*a* pressing rod
3*b* sealing member
3*c* opened part
3*d* bottom surface
3*e* mechanically weak portion
3*f* knob part
3*g* storing part
3*h* locking portion
4 pressing cap
4*a* groove for guiding
4*b* large diameter cylindrical part
4*c* small diameter cylindrical part
4*d* threaded part
4*e* contacting portion
4*f* bottom portion
5 powdered tea
6 openable lid
6*a* projected portion
6*b* threaded part
6*c* upper portion
6*d* sealing member
6*e* lowest end part
7 cap
7*a* small diameter cylindrical part
7*b* large diameter cylindrical part
7*c* wall part
7*d* threaded part
7*e* highest end part
7*f* pawl portion
10 body
11 drinking water
12 beverage container

BEST MODE FOR CARRYING OUT THE INVENTION

Hereinafter, some examples in which a powdered tea (5) sawed with a mortar is used as a mixture (5) according to the present invention will be described using FIGS. 1 to 7. The mixture (5) may be powdery, granular or liquid.

The beverage container consisting of a bottle of PET has a drinking water (11) such as mineral water in its body (10), and a cap (1) is removably fixed and screwed to a threaded part (10*b*) formed on an outer circumferential surface of the bottle mouth (10*a*) of the body, as shown in FIG. 1.

EXAMPLE 1

Figure 2:
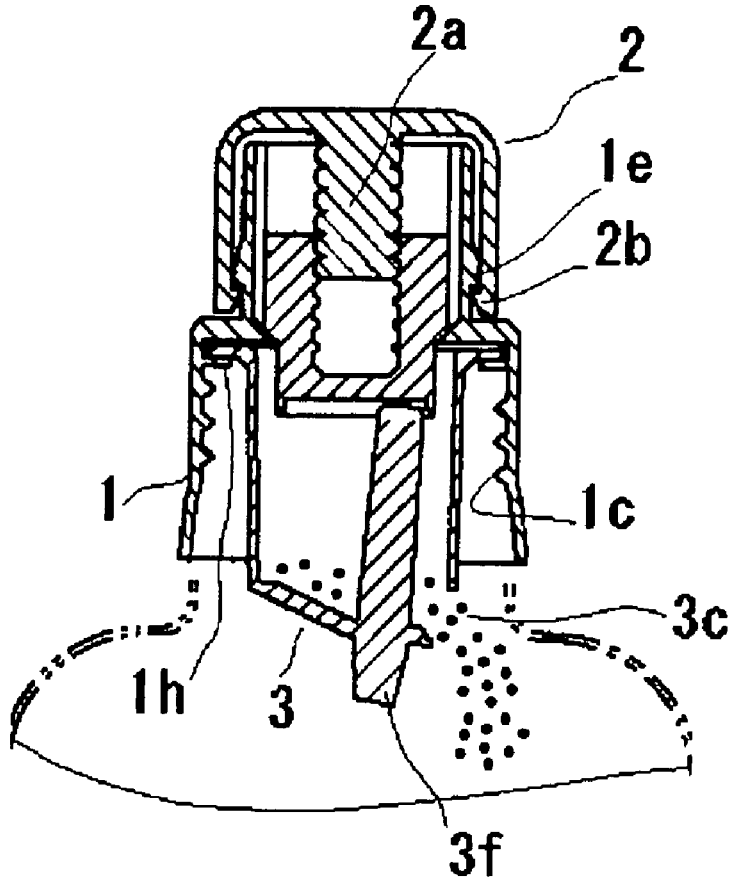
FIG. 2 It is an explanatory view of mixing state in Example 1 according to the present invention.

The cap (1) consists of a cap (1) having a shape in which a small diameter cylindrical part (1*a*) is bonded to the upper side of a large diameter cylindrical part (1*b*), an openable lid (2) attached so as to cover the small diameter cylindrical part (1*a*) of the cap (1), a pressing cap (4) which is disposed in the small diameter cylindrical part (1*a*) and is capable of moving downward at the same time of rotation of the openable lid (2), and a container (3) which has a powdery tea (5) setting in the large diameter cylindrical part (1*b*) and under the pressing cap (4), shown in FIGS. 1 and 2.

Figure 3:
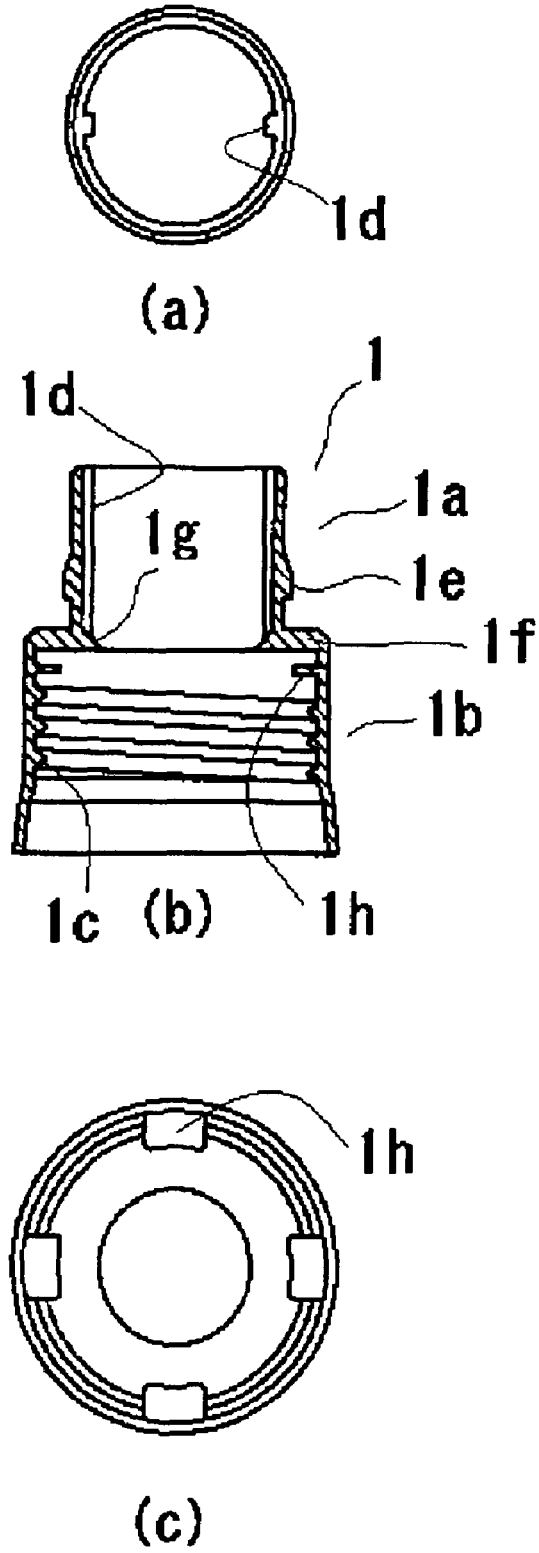
FIG. 3 It is an explanatory view of a cap. (a) planatory view, (b) cross-sectional view, (c) bottom surface view.

The cap (1) shown in FIG. 3 is made of a synthetic resin, namely polypropylene resin (PP) and has a shape wherein a small diameter cylindrical part (1*a*) is bonded to the upper side of a large diameter cylindrical part (1*b*), and a threaded part (1*c*) is disposed at an inner circumferential surface of the large diameter cylindrical part (1*b*) for removably screwing onto a threaded part (10*b*) formed on a bottle mouth.

A projection for guiding is formed while extending axially in the small diameter cylindrical part (1*a*) of the cap (1). This is fitted in a groove for guiding (4*a*) formed in the pressing cap (4) disposed in the small diameter cylindrical part (1*a*) of the cap (1) to control the moving of the pressing cap (4) only upward and downward. Further, a projection for locking (1*e*) having a tapered shape spreading from upper side to lower side is formed around the circumference under the outer circumferential surface of the small diameter cylindrical part (1*a*).

Moreover, a lowest end part (1*g*) having a tapered shape and narrowing downward is formed circumferentially on a cross-section surface of the wall (1*f*) of a bound portion between the small diameter cylindrical part (1*a*) and the large diameter cylindrical part (1*b*). And four pawl portions (1*h*) are formed circumferentially on a lower surface side of the wall (1*f*) for locking a locking portion of the container.

In addition, the outer circumferential surface of the large diameter cylindrical part (1*b*) is subjected to a non-slip processing such as knurl not indicated.

The openable lid (2) shown in FIGS. 1 and 2 is made of a synthetic resin, namely polypropylene resin (PP), provides a threaded part (2*a*) which has an approximately cylindrical shape opened downward and projects downward from the center of the upper portion. The locking portion (2*b*) is formed at the lowest end part of the inner circumferential surface of the cylindrical part of the openable lid (2) for fitting to a projection for locking (1*e*) formed on the small diameter cylindrical part (1*a*) of the cap (1). When the openable lid (2) is attached so as to cover the small diameter cylindrical part (1*a*) of the cap (1), the locking portion (2*b*) is locked with the projection for locking (1*e*) of the cap (1) to prevent the openable lid from removing upward and to enable rotation to only a circumference.

In addition, the outer circumferential surface of the openable lid (2) is subjected to a non-slip processing such as knurl.

Figure 4:
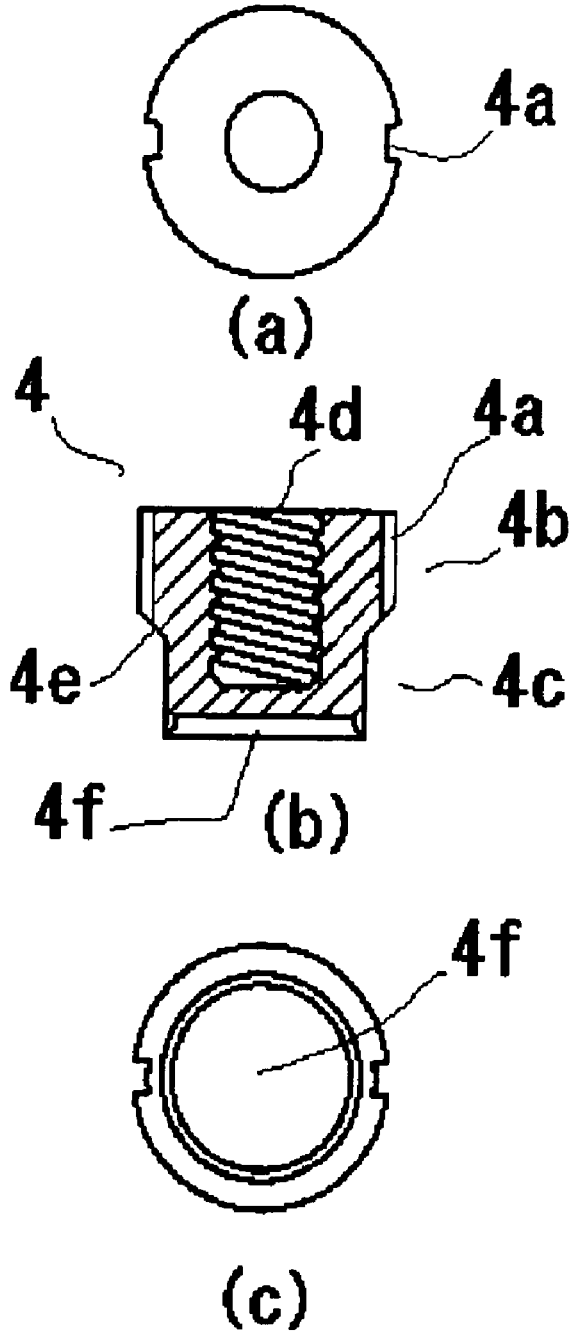
FIG. 4 It is an explanatory view of a pressing cap. (a) planatory view, (b) cross-sectional view, (c) bottom surface view.

The pressing cap (4) shown in FIG. 4 has a shape wherein the small diameter cylindrical part (4*c*) is combined with the lower portion of the large diameter cylindrical part (4*b*), and is made of a synthetic resin, namely polypropylene resin (PP). The threaded part (2*a*) formed on the openable lid (2) and the threaded part (4*d*) removably to be screwed are configured on the center of the upper surface of the large diameter cylindrical part (4*b*). The groove (4*a*) for guiding is disposed on the side surface for fitting to the projection (1*d*) for guiding of the cap disposed while facing.

Additionally, a contacting portion (4*e*) which has a tapered shape and joins the large diameter cylindrical part and the small diameter cylindrical part continuously is disposed at the joined part of the large diameter cylindrical part (4*b*) and the small diameter cylindrical part (4*c*) for closely contacting to the lower end part (1*g*) of the wall (1*f*) wherein the cap (1) has.

Further, a concave bottom portion (4*f*) is formed on a lower surface side of the small diameter cylindrical part (4*c*) for not removing the pressing rod (3*a*) from the lower surface side of the pressing cap (4) in the case of pressing the pressing rod (3*a*) of the container (3) described below.

Since the groove (4*a*) for guiding of the pressing cap (4) is fitted in the projection (1*d*) for guiding disposed inside of the cap (1), the pressing cap (4) never rotates. And the pressing cap (4) moves downward with a rotation of the openable lid (2) shown in FIG. 2 to push the pressing rod (3*a*) of the container (3) downward and break the mechanically weak portion (3*e*) on the bottom surface (3*d*) of the container (3) reliably.

And when the mechanically weak portion (3*e*) on the bottom surface (3*d*) of the container (3) is broken to form the opened part (3*c*), a powdery tea (5) stored in the container (3) can be dropped down from the opened part (3*c*) to a drinking-water (11) to mix.

Figure 5:
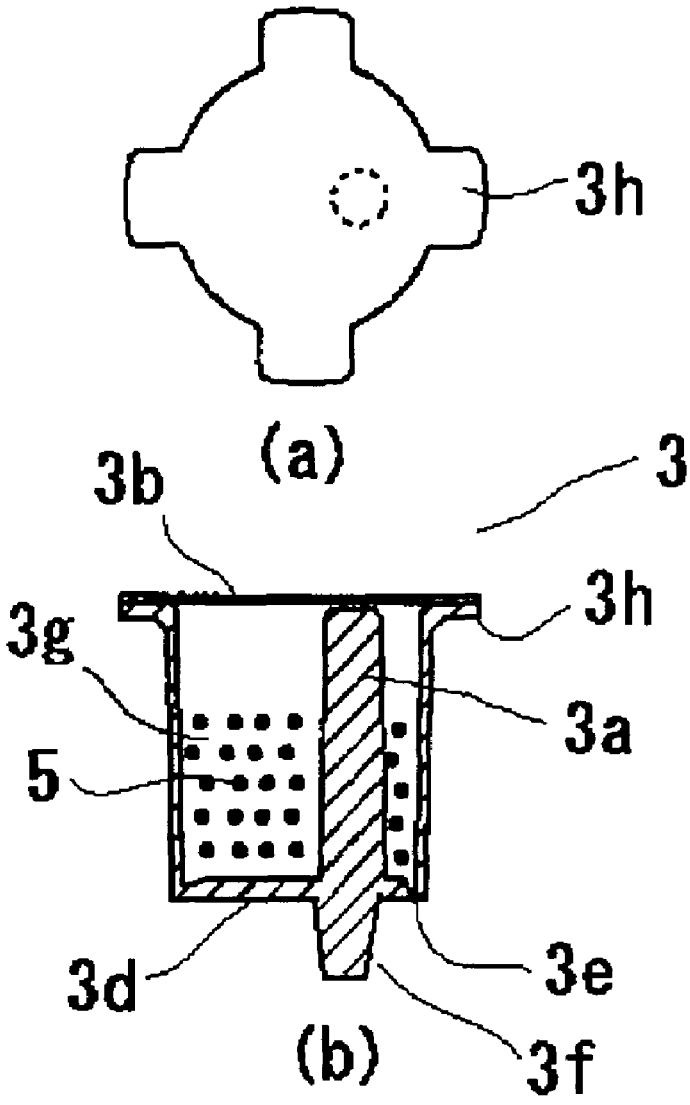
FIG. 5 It is an explanatory view of a container. (a) planatory view, (b) cross-sectional view.

The container (3) shown in FIG. 5 is made of a synthetic resin, namely polypropylene resin (PP) and has an approximately bottomed cylindrical shape opened upward.

On the bottom surface (3*d*) of the container (3), the mechanically weak portion (3*e*) such as a thin wall part and a groove that are formed in circular is disposed. The pressing rod (3*a*) projecting upward is configured near the mechanically weak portion of the bottom surface (3*d*).

The pressing rod (3*a*) is integrated with the bottom surface (3*d*) so as to transmit a pressure efficiently from the pressing cap (4) to the mechanically weak portion of the bottom surface (3*d*). In addition, the knob part (3*f*) is disposed on the bottom surface of the container (3) so as to remove from the cap (1).

Further, a storing part (3*g*) is disposed in the container (3) for storing the powdery tea (5). In addition, four locking portions (3*h*) are provided in circular on the outer circumferential surface of the upper surface of the container (3). When the locking portion (3*h*) is locked by the pawl portion (1*h*) of the cap (1), the locking portion (3*h*) is attached to an upper surface of the container body by a sealing member such as a packing not indicated to enable the container (3) to contain in the bottle mouth (10*a*).

After containing a powdery tea (5) in the storing part (3*g*) of the container (3), a sheet-like sealing member (3*b*) such as an aluminum film is disposed on an upper part by sticking or welding to a condition where the storing part (3*g*) is completely sealed.

Therefore, a flavor just ground can be conserved for a long time and a flavored good tea just made can be tasted in drinking.

Next, a drinking method of the present Example will be described.

The present beverage is in a state where a powdery tea (5) in finely particular by a mill or the like is stored in a container (3) and a drinking water (11) and the powdery tea (5) are always separated in the beverage container (12) and is sold at a store or via an automatic vending machine.

When the beverage is tasted, the openable lid (2) disposed on the beverage container body (10) is turned in anti-clockwise. The rotation direction can be selected by setting the threaded part (2*a*) of the openable lid (2) and the threaded part (4*d*) of the pressing cap (4) to a right screw thread and a left screw thread, respectively. It is not limited to the direction in anti-clockwise and the rotation direction may be turned in clockwise.

When the openable lid (2) is turned, the pressing cap (4) is moved downward along the projection (1*d*) for guiding disposed inside of the small diameter cylindrical part (1*a*) of the cap (1) by the groove (4*a*) for guiding disposed in the pressing cap (4). And when the pressing rod (3*a*) disposed in the container (3) is pressed down, the mechanically weak portion (3*e*) near the bottom surface (3*d*) of the container (3) is broken.

This operation makes the powdered tea (5) in the container (3) dropping into the drinking water (11) from the opened part (3*c*), as shown in FIG. 2.

Since the bottom surface (3*d*) of the container (3) has a normal thick wall part except the mechanically weak portion, the bottom surface never leaves integrally and drops down to a side of the drinking water (11) shown in FIG. 2. And a floating of fractions of the bottom surface (3*d*) in the drinking water (11) and the like is suppressed, being preferable in sanitary and safety.

As also shown in FIG. 2, a contacting portion (4*e*) having a tapered shape at a joined part between the large diameter cylindrical part (4*b*) and the small diameter cylindrical part (4*c*) of the pressing cap (4) contacts a lower end part (1*g*) of the wall (1*f*) at a joined part between the large diameter cylindrical part (1*b*) and the small diameter cylindrical part (1*a*) that are corresponding to the cap to be in a sealed state. Therefore, when a drinking water (11) and the powdery tea (5) are mixed and agitated, the beverage container (12) is shaken up-and down. However, it has a structure where a leakage of the drinking water (11) in the beverage container (12) never occurs in this case.

When the cap (1) is turned in anti-clockwise after blending, the container (3) is integrated, namely, the cap (1) and the container (3) are integrated. And when the integrated of the cap (1) and the container (3) is put off the bottle mouth (10*a*), the beverage may be tasted.

In this way, easy manipulation wherein the openable lid (2) is simply turned leads to mixing of the drinking water (11) and the powdery tea (5) in the container (3) reliably.

Further, when the cap 1 integrated is turned while drawing the knob part (3*f*) disposed in the container (3), the container (3) can be easily put off. Therefore, it is easy to exchange a container having the other mixture, and attaching the container onto the body (10) containing a new drinking water (11) leads to many time uses.

EXAMPLE 2

In the following, Example 2 is described focusing on differences from Example using FIGS. 6 and 7.

The cap (7) consists of a cap (7) having a shape in which a small diameter cylindrical part (7*a*) is bonded to the upper side of a large diameter cylindrical part (7*b*), an openable lid (6) which has a cylindrical shape, is communicated downward while attaching so as to cover the small diameter cylindrical part (7*a*) of the cap (7) and has a projected portion (6*a*) at the central, and a container (3) which is disposed inside of the large diameter cylindrical part (7*b*) of the cap (7) same as the case in Example 1.

The description on the construction of the container (3) is omitted because it is the same as the case in Example 1. In addition, since the container (3) is fixed by a pawl portion (7*f*) disposed in the cap in the same manner as Example 1, the container (3) can be easily removed.

The cap (7) is made of a synthetic resin, namely polypropylene resin (PP) and has a shape wherein the small diameter cylindrical part (7*a*) is bonded to the upper side of the large diameter cylindrical part (7*b*) as same as the case in Example 1. The large diameter cylindrical part (7*b*) and a wall (7*c*) of a joined portion between the large diameter cylindrical part (7*b*) and the small diameter cylindrical part (7*a*) are the same as Example 1. And a threaded part (7*d*) is disposed at an outer circumferential surface of the small diameter cylindrical part (7*a*) for screwing onto a threaded part (6*b*) disposed at an inner circumferential surface of the openable lid (6).

Figure 6:
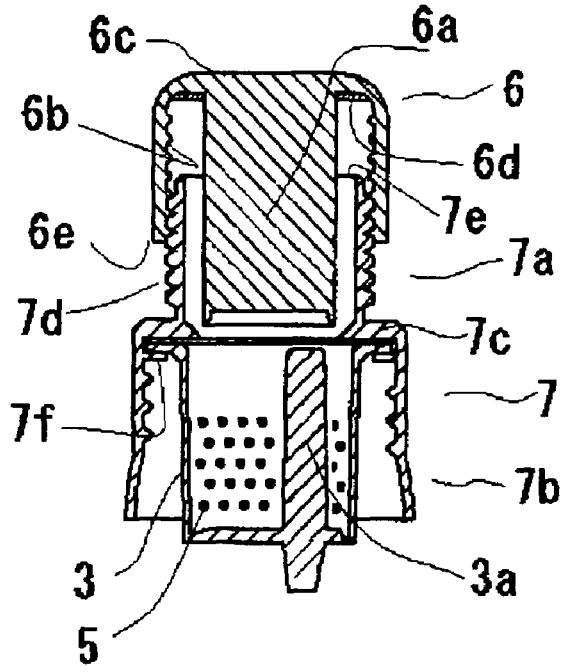
FIG. 6 It is an explanatory view of Example 2 according to the present invention.

The openable lid (6) shown in FIG. 6 is made of a synthetic resin, namely polypropylene resin (PP), has a cylindrical shape opened downward, and provides a projected portion (6*a*) projecting downward from the center of the upper portion. And a threaded part (6*b*) is disposed at the inner circumferential surface. Further, a sealing member (6*d*) is installed in a gap between an upper portion (6*c*) and the projected portion (6*a*). When this sealing member (6*d*) is contacted with a highest end part (7*e*) of the small diameter cylindrical part (7*a*) of the cap (7) in a state of shutting the openable lid (6), a sealed state is formed.

Figure 7:
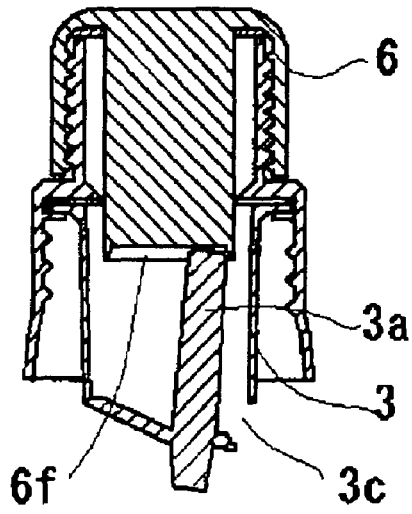
FIG. 7 It is an explanatory view of mixing state in Example 2 according to the present invention.

As shown in FIG. 7, when the openable lid (6) is rotated to sealed state mentioned above, the projected portion (6*a*) of the openable lid (6) pushes the pressing rod (3*a*) of the container (3) to break the bottom surface (3*d*), drop the powdery tea (5) down to the drinking water (11) and mix. The sealed state is maintained and leakage of the drinking water (11) in the beverage container (12) does not occur.

Further, when the projected portion (6*a*) of the openable lid (6) and the pressing rod (3*a*) of the container (3) are in contact, a collar member having a mechanically weak portion for breaking and not indicated may be configured at a lowest end part (6*e*) of the openable lid (6). Thereby the openable lid (6) is not rotated carelessly and the bottom surface (3*d*) of the container (3) may not be broken.

It is noted that a bottom surface (6*f*) of the projected portion (6*a*) of the openable lid (6) has a same construction as the bottom portion (4*f*) of the small diameter cylindrical part (4*c*) of the pressing cap (4) in Example 1.

When the beverage is tasted, the openable lid (6) disposed on the beverage container body (10) is turned in anti-clockwise in the same manner as Example 1. The rotation direction can be selected by setting the threaded part (6*a*) of the openable lid (6) and the threaded part (7*d*) of the cap (7) to a right screw thread and a left screw thread, respectively. It is not limited to the direction in anti-clockwise and the rotation direction may be turned in clockwise.

Additionally, in order to prevent unauthorized operations in Examples 1 and 2, a confirmation member of opening having a shape of a strap or a sheet may be attached to the outside of the cap (1) and (7), and the openable lids (2) and (6) to ensure an operation by openable lids (2) and (6).

The mixture (5) to contain in the storing part (3*g*) of the container (3) is not limited to the powdery tea (5) according to the present Example. A mixture except the present Example includes coffee, tea, fruit juice, milk, table sugar, alcoholic beverage, extract and the like and these may be powdery, granular or liquid to contain.

INDUSTRIAL APPLICABILITY

The thing to be stored in the body is not limited to a drinking water. Therefore the use of the present invention is exemplified to chemicals, coatings, adhesives and the like that are used after blending in addition to ones in liquid and in powdery.

What is claimed is:

1. A cap structure comprising a cap removably to be screwed onto a bottle mouth of a beverage container body containing a drinking water therein and a container disposed in said cap for storing a mixture, characterized in that, said cap has a shape in which a small diameter cylindrical part is bonded to the upper side of a large diameter cylindrical part, said container that has a bottom and is cylindrical is disposed so as to project downward in order to store said mixture in said large diameter cylindrical part, a mechanically weak portion is formed at a bottom surface of said container, a pressing rod that is projected upward is disposed near said mechanically weak portion, said container is supported with a pawl portion that is formed while extending from a circumferential side near an upper end of said large diameter cylindrical part of said cap toward the center of said cap, and a locking portion that is formed while extending from a circumferential edge portion toward outside of an upper surface of said container, a pressing cap disposed at an upper surface of said pressing rod is housed in said small diameter cylindrical part and is freely threaded to a threaded part configured in an openable lid disposed while capping said small diameter cylindrical part of said cap, said cap has a projection for guiding in said small diameter cylindrical part, said projection for guiding fitted into a groove part formed on an outer circumferential side of said pressing cap to control the rotation of said pressing cap, and when said openable lid is rotationally moved, said pressing cap is pushed downward, said pressing rod of said container is pressed down to break said mechanically weak portion of said bottom surface and open, and said mixture in said container is dropped into said drinking water.

2. The cap structure according to claim 1, wherein a lowest end part of said small diameter cylindrical part of said cap and a sided circumferential surface of said pressing cap closely contact when said mechanically weak portion of said container is broken.

3. The cap structure according to claim 1, wherein a concave bottom portion is formed on a lower surface of said pressing cap.

4. A cap structure comprising a cap removably to be screwed onto a bottle mouth from a beverage container body containing a drinking water therein and a container disposed in said cap for storing a mixture, characterized in that, said cap has a shape in which a small diameter cylindrical part having a threaded part on an outer circumferential side is bonded to the upper side of a large diameter cylindrical part, said container that has a bottom and is cylindrical is disposed so as to project downward in order to store said mixture in said large diameter cylindrical part, a mechanically weak portion is formed at a bottom surface of said container, a pressing rod that is projected upward is connected to said bottom surface and disposed near said mechanically weak portion, said container is supported with a pawl portion that is formed while extending from a circumferential side near an upper end of said large diameter cylindrical part of said cap toward the center of said cap, and a locking portion that is formed while extending from a circumferential edge portion toward outside of an upper surface of said container, an openable lid that is disposed at an upper surface of said pressing rod of said container, has a cylindrical shape downward and comprises a projected portion on a center of the upper side, caps said small diameter cylindrical part of said cap and is freely threaded to a threaded part, and when said openable lid is rotationally moved, said pressing rod of said container is pressed down with said projected portion to break said mechanically weak portion of said bottom surface and open, and said mixture in said container is dropped into said drinking water.

5. The cap structure according to claim 4, wherein a tip part of said small diameter cylindrical part of said cap and a sealing member on an upper face of said openable lid closely contact when said mechanically weak portion of said container is broken.

6. The cap structure according to claim 4, wherein a concave bottom portion is formed on a lower surface of said projected portion.

7. The cap structure according to claim 1 or 4, wherein a knob part is disposed at a bottom surface of said container.

* * * * *